US006051034A

United States Patent [19]

Caldwell

[11] Patent Number: 6,051,034

[45] Date of Patent: Apr. 18, 2000

[54] METHODS FOR REDUCING PILLING OF TOWELS

[75] Inventor: Melvin A. Caldwell, Kingsport, Tenn.

[73] Assignee: Springs Industries, Inc., Fort Mill, S.C.

[21] Appl. No.: 09/164,234

[22] Filed: Sep. 30, 1998

[51] Int. Cl.[7] ..... D06M 11/00

[52] U.S. Cl. ..... 8/116.1; 8/114.6

[58] Field of Search ..... 8/116.1, 114.6

[56] References Cited

U.S. PATENT DOCUMENTS

| | | |
|---|---|---|
| 1,395,472 | 11/1921 | Bosshard . |
| 3,087,775 | 4/1963 | Reinhardt et al. . |
| 3,144,299 | 8/1964 | Frick, Jr. et al. . |
| 3,189,404 | 6/1965 | Takizaki et al. . |
| 3,268,291 | 8/1966 | Mack et al. . |
| 3,269,797 | 8/1966 | Tauss . |
| 3,288,553 | 11/1966 | Lemieux . |
| 3,305,315 | 2/1967 | Bacon et al. . |
| 3,807,952 | 4/1974 | Lauchenauer . |
| 3,811,131 | 5/1974 | Gamarra et al. . |
| 3,811,210 | 5/1974 | Cashen et al. . |
| 3,870,555 | 3/1975 | Swidler et al. . |
| 3,918,903 | 11/1975 | Kullman et al. . |
| 3,928,528 | 12/1975 | Orito et al. . |
| 4,004,878 | 1/1977 | Magosch et al. . |
| 4,088,443 | 5/1978 | Kullman et al. . |
| 4,376,633 | 3/1983 | Reinhardt et al. . |
| 4,615,708 | 10/1986 | Blanchard et al. . |
| 4,806,125 | 2/1989 | Dyer . |
| 4,936,865 | 6/1990 | Welch et al. . |
| 5,199,953 | 4/1993 | Fung et al. . |
| 5,300,626 | 4/1994 | Jehl et al. . |
| 5,397,483 | 3/1995 | Porter et al. . |
| 5,478,909 | 12/1995 | Jehl et al. . |
| 5,496,477 | 3/1996 | Tang et al. . |

*Primary Examiner*—Margaret Einsmann
*Attorney, Agent, or Firm*—Alston & Bird LLP

[57] ABSTRACT

A method is provided for reducing pilling of cellulosic towels. A composition comprising an acidic agent, and optionally a fabric softener, is applied to a pillable cellulosic towel, preferable to the face yarns of the towel. The towel is then heated for a time and under conditions sufficient to effect a controlled degradation of the cellulose fibers, thereby reducing pilling. The resultant towels can exhibit water absorbency comparable to untreated towels.

17 Claims, No Drawings

METHODS FOR REDUCING PILLING OF TOWELS

FIELD OF THE INVENTION

This invention relates to methods for treating cellulosic fabrics, and more particularly to methods for reducing pilling of cellulosic pile towels.

BACKGROUND OF THE INVENTION

Towels are generally woven on looms to include a ground fabric and an extra set of warp yarns. The yarns of this extra set are interlaced with the ground warp and filling yarns to form a plurality of loops or cut ends which extend outwardly from one or both surfaces of the ground fabric to form a pile.

Because towels are generally used to dry other objects, they are customarily designed to be highly absorbent. To this end, towels have historically been manufactured from all or substantially all cellulosic yarns such as cotton yarns.

While cellulosic fibers have been found to be advantageous in many respects (i.e., they are absorbent, relatively durable, and generally available), they also present several drawbacks. Typically, fibers protrude from the surface of the fabric which can entangle during use, particularly during laundering, and form "pills" or fuzz balls. For example, shorter, weaker fibers tend to work to the surface during the laundry cycles and be trapped by longer and stronger fibers. This can result in a very undesirable appearance of the towel.

Enzyme hydrolysis of cotton is currently practiced to reduce the strength of the stronger fibers to allow the pills to break away. Typically towels are subjected to enzyme hydrolysis after the towels have been sewn to finished dimensions, thus requiring additional processing steps. In addition, the process is relatively expensive.

SUMMARY OF THE INVENTION

It is thus an object of the present invention to provide a simple and cost-effective method for preventing pilling of cellulosic towels. It is another object of the invention to provide a method for removing pills from cellulosic towels. It is a further object of this invention to produce cellulosic towels that are substantially pill-free without significantly decreasing water absorbency, softness, and the like and while retaining sufficient tensile strength for serviceability.

These and other objectives of the present invention can be achieved by applying a composition which includes a suitable acidic agent to cellulosic pile fabrics (e.g., toweling) and heating the fabric for a time sufficient and under conditions sufficient to substantially decrease or minimize pilling without significantly adversely affecting other desirable properties of the fabric. The acidic agent can be any one of a variety of commercially available acid treating agents such as an organic acid, mineral acid, acid-forming material, and the like, or mixtures thereof. Preferred concentrations of the acidic agent range from about 0.01% to about 20%, more preferably from about 0.05% to about 10%, by weight based on the total weight of the composition. In addition, advantageously the composition includes a fabric softener.

After the composition is applied to the towel, the fabric is heated for a time and under conditions sufficient to provide a towel exhibiting reduced or minimal pilling. The towel is preferably heated at a temperature ranging from about 200° F. to about 400° F., more preferably from about 250° F. to about 350° F., and most preferably from about 285° F. to about 310° F. In general, the concentration of the acid agent, the temperature and the treatment time are adjusted to each other to provide the desired anti-pilling affect to the fabric.

While not wishing to be bound by any explanation of the invention, it is believed that the acidic agent when applied under appropriate time and temperature conditions acts upon cellulosic fibers of the towel material to hydrolyze and weaken the fibers so that protruding fibers can readily break away (for example during laundering). This in turn can minimize pills clinging to the surface of the towel.

The inventors have further found that pilling can be reduced without significantly impacting other desirable properties of the toweling material. For example, the inventors have found that the treated towels maintain sufficient strength so as to withstand the rigors of several laundering cycles. The application of the acidic agent also does not significantly decrease water absorbency of the towel, and the treated towels exhibit desirable aesthetics, such as a soft hand or feel, flexibility, and the like. These and other advantages are surprising in view of prior techniques for imparting durable press properties to non-terry cellulosic fabrics using polycarboxylic acids, typically in combination with another catalyst material, to crosslink the acid onto the cotton fibers. Additionally, the cost of the process of the invention is substantially less than the cost of enzyme processes; however, the process of the invention provides anti-pilling and softness benefits the same as or superior to the costly enzyme processes.

DETAILED DESCRIPTION OF THE INVENTION

As noted above, conventional towels and pile fabrics for producing towels and like articles generally include a woven ground fabric and a plurality of pile yarns extending outwardly from the fabric. The woven ground fabric includes a set of warp yarns which are substantially parallel to each other and a set of weft or filling yarns which are substantially parallel to each other, with the warp and weft yarns being substantially perpendicular to each other. The yarns of each of the respective sets are periodically interlaced with the yarns of the other set to form a woven fabric.

The pile yarns are desirably formed as additional warp yarns interspersed between the ground warps and interlaced with the weft yarns so as to be tied into the ground fabric in a known manner. In a preferred form of the invention, the pile yarns are in the form of terry loops; alternatively, the pile yarns could be provided in the form of cut ends. Preferably the pile yarns extend from both faces of the ground fabric, to form upper and lower pile faces on the towel. The present invention can also be used with knitted pile fabrics, as known in the art.

Although the methods of the invention are discussed specifically with respect to towels, it is noted that the term "towel" is intended to cover a variety of pile cellulosic fabric articles, including but not limited to bath mats, wash cloths, dish towels, hair drying towels, and the like. Pile fabrics used to make towels and the above pile fabric articles can also be effectively treated in the present invention.

The textile material of the fabrics treated according to the teachings of this invention include cellulosic fibers, either natural or regenerated. The fabric preferably includes at least about 50% by weight cellulosic fibers, more preferably at least about 80% by weight cellulosic fibers, and most preferably about 100% by weight cellulosic fibers. Exemplary cellulosic fabrics include natural cellulosic fibers, such as cotton fibers, regenerated cellulosic fibers, such as rayon fibers, and the like and mixtures thereof. The towels can also include synthetic fibers, such as but not limited to polyester fibers, polyamide fibers, polyolefin fibers, and the like and mixtures thereof.

The fabrics can be pilled fabrics which have been subjected to multiple laundering cycles or other treatments which results in pilling. In such cases, the invention can be useful in removing existing pills as well as preventing further pilling. Fabrics which are substantially free of pills (for example, towels which have never been laundered or other virgin fabrics) can also be treated in accordance with the invention to effectively prevent or reduce pilling during laundering cycles or other uses. The resultant towels generally exhibit minimal pilling, for example, can exhibit a pill rating of about 2.5 to 5, preferably about 3.5 to 5, on a scale of 1–5, per ASTM 3512-96 determined using test standard AATCC Test Method 124-1996 (Laundry Method). The skilled artisan will appreciate that suitable pill ratings can vary depending upon factors such as quality of the cellulosic fibers of the fabric, initial appearance of the towel prior to treatment and the desired amount of improvement in pilling.

In the method, a composition which includes at least one acidic agent is applied to the towel and the towel treated to minimize or prevent pilling of the towel. The composition preferably includes water as the solvent, although inert organic solvents capable of solubilizing or uniformly dispersing the acidic agent, or mixed aqueous/organic solvent systems, can also be used.

The acidic agent can be an acid or acid-forming material which is capable of acting upon cellulosic fibers of the towel material to reduce or minimize pilling. While not wishing to be bound by any theory or explanation of the present invention, it is currently believed that the acidic agent can weaken the cellulosic fibers of the towel and thus allow pills to break away during laundering. Although the invention can reduce tensile strength of individual fibers, and of the towel as a whole, the inventors have found that the properly treated towels maintain sufficient strength so as to withstand the rigors of several laundering cycles.

Useful acids include organic acids and mineral acids. Exemplary organic acids include water soluble or emulsifiable organic acids, such as but not limited to carboxylic acids such as formic acid, citric acid, oxalic acids, malic acid, propionic acid, and the like as well as other organic acids such as benzenesulfonic acid, toluenesulfonic acid, and the like. Exemplary mineral acids include but are not limited to sulfuric acid, hydrochloric acid, phosphoric acid, nitric acid, and the like. Acid-forming materials include, for example, Lewis acids, acid forming salts, and the like, such as but not limited to, magnesium chloride, magnesium bromide, magnesium sulfate, magnesium nitrate, zinc nitrate, ammonium nitrate, ammonium sulfate, ammonium chloride, aluminum chloride, zinc chloride, and the like.

Mixtures of acidic agents described above can also be employed, so long as the agents are compatible with each other and with other components of the solution. The ratio of acidic agents can vary, depending upon factors such as, but not limited to, resultant fabric strength reduction, discoloration, and the like. For example, in one embodiment of the invention, a mixture of malic acid and magnesium chloride, optionally containing softener, is applied to a cellulosic pile fabric. In this embodiment of the invention, the mixture generally includes a ratio of acidic agents (such as malic acid:magnesium chloride) ranging from about 1:10 to about 10:1, although values outside this ratio can also be used.

The composition preferably also includes at least one fabric softener as known in the art. Suitable fabric softeners include without limitation cationic fabric softeners such as fatty acid salts, quaternary ammonium salts, and the like; non-ionic fabric softeners such as polyethylene, polypropylene, and the like; anionic fabric softeners such as sulphonated waxes, sulphonated oils; and the like and mixtures thereof. Such fabric softeners are known and are commercially available. For example, a currently preferred fabric softener is commercially available under the name Springsoft 3230 from Springs Chemical Company.

The concentration of the acidic agent can vary depending upon factors such as the acidic agent used, the presence or absence of a fabric softener, residual alkali, or other agents, towel construction (such as fiber composition, weave pattern, etc.), and the like. Generally, lower concentrations of stronger acidic agents (i.e., increased ability to hydrolyze cellulosic materials thus reducing fiber strength) is required, as compared to weaker acidic agents. Advantageously, the acidic agent is applied in an amount sufficient to minimize loss or reduction of tensile strength of the towel yet also to achieve a desired level of pill reduction. Preferably, the concentration of the acidic agent on the fabric ranges from about 0.01% to about 20%, more preferably from about 0.05% to about 10%, by weight based on the total weight of the fabric.

Generally, the softener concentration and the strength of the acidic agent are correlated with each other. Fabric softeners are especially useful in combination with stronger acids to prevent excessive action by the acids. For example, if a relatively strong acidic agent is used (for example, an acid having increased ability to hydrolyze cellulosic materials), the concentration of the softener is typically increased. Preferably, the amount of fabric softener on the fabric ranges from about 0.1% to about 5.0% by weight.

The composition can be prepared using known methods. For example, in one embodiment of the invention, to improve light transmission and minimize yellowing or discoloration, the softener (when present) can be first dissolved in solvent (advantageously water) prior to addition of the acidic agent. Alternatively, a concentrate of acidic agent and optionally softener can be prepared and diluted prior to application to the fabric to provide the desired weight percent of each component on the fabric. In yet another embodiment of the invention, the concentrate can be applied by passing the fabric over a kiss roll, wherein linear speed of the fabric over the roll and the speed of rotation of the kiss roll are selected to provide the desired weight percent of acidic agent on the fabric. For example, a concentrate comprising about 1 to about 20 weight percent malic acid and about 1 to about 20 weight percent magnesium chloride can be applied using a kiss roll.

The compositions can be applied to dry or wet fabrics using techniques known in the art, such as but not limited to padding, spraying, foam application, knife coating, kiss rolling, blotch printing, immersion in a bath of the composition, and the like. In one advantageous embodiment, the composition is applied using a padding wet-on-dry technique, i.e., padding the solution to a dry fabric. Preferably, the fabric is treated to provide about 10% to about 200%, more preferably about 50% to about 150%, and most preferably about 80% to about 100%, wet pick up, of the solution onto the fabric. Wet-on-wet padding techniques, i.e., padding the solution onto pre-wetted fabrics, can also be used, provided that the concentration of the components of the composition is adjusted to account for the reduced wet pick up and dilution that may occur when using this technique.

Typically, pilling is believed to result from interaction of the face yarns of the fabrics, with the ground yarns making little contribution to this problem. It therefore can be desirable to apply the composition primarily to the face yarns to provide the desired effect on the face yarns without a significant impact on the strength of the ground yarns.

After the composition is applied to the towel, the fabric is heated for a time and under conditions sufficient to provide a towel exhibiting reduced or minimal pilling. The towel can be heated using conventional heating devices, such as but not limited to, production loop dryers, tenter frames, drum dryers, dry cans, multipass ovens, tumble dryers, and the like. The fabrics preferably are heated at a temperature ranging from about 200° F. to about 400° F., more preferably from about 250° F. to about 350° F., and most preferably from about 285° F. to about 310° F. Drying times may vary, depending upon various factors such as pickup percentage, temperature, heating apparatus, air flow and the like, and typically range from about 3 to about 60 minutes, although times outside this range can also be used.

As will be appreciated by the skilled artisan, the time and temperature conditions are inversely related, i.e., lower temperatures may require a longer dry time. In addition, as the skilled artisan will also appreciate, the strength of the acidic agent can also affect treatment conditions. For example, weaker acids can be used at higher concentrations, longer times and/or higher temperatures as compared to stronger acidic agents. Still further, time and temperature can vary for mixtures of acidic agents. The inventors have found that the fabric should be treated for a time sufficient and at a temperature sufficient to dry the fabric (typically about 30 –45 minutes, although drying times can vary depending on the factors noted above). The dry fabric is then further heated for a time sufficient and at a temperature sufficient to allow the acidic agent to achieve the desired properties (typically about 1 to 5 minutes for weaker organic acids and seconds for stronger mineral acids).

The treated toweling can then be passed to downstream processing to construct the desired end product, for example, towels, face cloths, etc., and the articles packaged for consumer use. The toweling can also be subjected to additional downstream processing, for example, washing to remove residual chemicals and by-products.

In addition, the fabric can be treated after addition of the composition by exposing the fabric to infrared (IR) energy. This can heat primarily the surface of the treated material and promote selective weakening of the surface fibers. Exposing dry toweling to IR is also believed to confine the hydrolysis effect to the surface fibers of the towel and thereby minimize weight loss in washing and drying.

The method of the invention provides several advantages in addition to reduction of pilling. For example, color change due to the proper treatment is generally small. The application of the acidic agent also does not significantly decrease water absorbency of the towel. Advantageously, the treated cellulosic towels exhibit water absorbency which is essentially unchanged from that of the untreated towels. Generally, the treated cellulosic towels of the invention exhibit a water absorbency value of about 0 to about 4 seconds, determined using the following procedures to test relative absorbency of samples. Values outside of this range can also be observed. A 1 inch by 1 inch square of towel is set flat on the surface of 500 cc of water in a 500 cc beaker. The time required for the sample to sink below the surface of the water is recorded. The reported number is an average of five replications. Loss of tensile strength also can be acceptable, typically ranging from about 20 percent to about 60 percent, as determined using ASTM D 5034-94. Still further, the treated towels exhibit desirable aesthetics, such as a soft hand or feel, flexibility, and the like.

The following examples further illustrate the preferred procedures of the invention and should not be considered as limiting the scope of the invention. All alternatives, modifications and equivalents as may be included within the spirit and scope of the invention as defined by the appended claims are intended to be covered.

The following test standards are discussed in the examples and are defined as follows:

Per ASTM D 3512 photographic standards the pilling rating scale is as follows:

1=Very severe pilling

2=severe pilling

3=moderate pilling

4=slight pilling

5=no piling

Note: The towels are not tested per ASTM D 3512-96 for which this scale was developed. The pills are developed during washing and tumble drying per AATCC Test Method 124-1996.

Weight loss: (Original weight in grams—washed weight in grams) (100)/Original weight in grams Tensile strength: ASTM 5034-95

Tensile strength loss: (Untreated towel tensile—treated towel tensile) (100)/untreated towel tensile Softness: Tactile subjective test vs. control Color change: Visual estimate by a trained observer.

0=no change

5% =very slight change

10% =slight change

20% =moderate change

30% =severe change

40% =very severe change

EXAMPLE 1

Treatment of Damaged Towel Using Acid Forming Salt

Commercially available 100% cotton towels commercially were laundered five times. The towel exhibited severe pilling (a "1" measured as discussed above). A composition was applied to the towel which included 2.5 weight percent of a composition which included malic acid and an acid forming salt, magnesium chloride, commercially available from Springs Chemical Company as "Catalyst 135B" to provide approximately 80% wet pick up ("wpu"). The towel was dried at 325° F. for 15 minutes.

After being washed and dried one cycle, the towel surface was void of pills, and the surface was actually cleaner than a matching new towel. Pilling was rated as a 5 on a scale of 1 to 5. After five wash/dry cycles, weight loss was about 5.3%, tensile strength loss was about 55% in the fill direction, with a residual tensile strength of about 35 pounds grab/inch, and no pills developed. Color change due to the treatment was very slight, i.e., less than 5 percent.

EXAMPLE 2

Treatment of New Towel Using Acid Forming Salt

To judge the efficacy of this treatment on unwashed towels, new commercially available towels as described above in Example 1 were evaluated before laundering. A composition including 5 weight percent of Catalyst 135B was applied to the towel surface to provide approximately 80% wet pick up. The towel was dried at 325° F. for 15 minutes.

The towel was then washed and dried 5 times. No pills were formed, and the rating was a 5, on a scale of from 1 to 5. The tensile loss was 76%, color change was minimal, and the hand and appearance were excellent. The appearance of the towel was superior to the original untreated towel. The washed towel has much more luster, and resembles a mercerized product. Weight loss was 3.5% after 1 wash and a cumulative 6.5% after 5 washes.

EXAMPLE 3

Treatment of New Towel Using Organic Carboxylic Acid

Example 2 was repeated except 1.0% citric acid was used in place of Catalyst 135B. The reduction in pills was significant. Tensile strength loss was 51%.

EXAMPLE 4

Variation of Towel Colors, Dry Times and Temperature

Eighteen commercially 100% cotton towels (six each in Hunter Green, Burgundy, and Navy) were treated as follows.

One each of the green, burgundy, and navy towels was evaluated by padding through 2.0 wt. % (OWB) Catalyst 135B and drying each towel for 15 minutes at 325° F. The samples were washed and dried one cycle and rated for pilling and weight loss. The towels were then washed and dried an additional four cycles and reevaluated. The results are set forth in Table I below.

TABLE I

| Color | % lint after 1 wash | % lint after 5 washes | % weight loss after 1 wash | % weight loss after 5 washes | pilling after 1 wash | pilling after 5 washes | tensile after 5 washes |
|---|---|---|---|---|---|---|---|
| Hunter | See note | See note | 0.49 | 3 | 5 | 5 | 34 |
| Burgundy | See note | See note | 4.31 | 8 | 5 | 5 | 27 |
| Navy | See note | See note | 1.29 | 5 | 5 | 5 | 27 |

Note:
After the first wash there was considerable cross contamination of lint on the wet towels before they were dried. After tumble drying for 1 hour all the lint was gone to the screen in the dryer. Total lint weight from the screen was 4.2 grams or 0.42%. The total lint weight from five consecutive washes of all samples was 13.9 grams or 1.4%.

The above was repeated for towels of the three colors except drying times were 10 minutes or 20 minutes. The results are set forth below in Tables II and III, respectively.

TABLE II

| Color | % lint after 1 wash | % lint after 5 washes | % weight loss after 3 washes | % weight loss after 5 washes | pilling after 1 wash | pilling after 5 washes | tensile after 5 washes |
|---|---|---|---|---|---|---|---|
| Hunter | See note | See note | 3 | 8 | 5 | 5 | 41 |
| Burgundy | See note | See note | 2 | 5 | 4 | 5 | 29 |
| Navy | See note | See note | 1 | 3 | 3 (fuzz) | 5 | 50 |

Note:
Total lint after 1 wash was 1.45 grams or only 0.2% and after 5 washes and was a total of 7.92 grams or 1.01% after 5 washes.

TABLE III

| Color | % lint after 1 wash | % lint after 5 washes | % weight loss after 1 wash | % weight loss after 5 washes | pilling after 1 wash | pilling after 5 washes | tensile after 5 washes |
|---|---|---|---|---|---|---|---|
| Hunter | See note | See note | 2 | 7 | 5 | 5 | 35 |
| Burgundy | See note | See note | 2 | 6 | 5 | 5 | 21 |
| Navy | See note | See note | 1 | 4 | 4.5 | 5 | 36 |

Note:
The total cumulative lint through five washes and dryings was 1.4%.

The above was again repeated for towels of the three colors except drying time was 10 minutes and temperature was 280° F. The results are set forth below in Table IV.

TABLE IV

| Color | % lint after 1 wash | % lint after 5 washes | % weight loss after 1 wash | % weight loss after 5 washes | pilling after 1 wash | pilling after 5 washes | tensile after 5 washes |
|---|---|---|---|---|---|---|---|
| Hunter | See note | See note | 2.4 | 3 | 4 | 5 | 52 |
| Burgundy | See note | See note | 2.2 | 2 | 2 | 5 | 40 |
| Navy | See note | See note | 1.8 | 2 | 1 | 2 | 47 |

Note:
The total lint from all three towels was 0.12% after the first wash and a cumulative total of 4.83% after the fifth wash.

EXAMPLE 5

Effect of Fabric Softeners

One half of a burgundy towel as described in Example 4 above was padded, wet-on-dry, with a solution containing 2.0% citric acid and 13.6% fatty amide/wax blend fabric softener, commercially available as Springs Soft 3230. In addition, one half of a navy towel, also as described in Example 4, was padded wet-on-wet with the same solution. As a control, burgundy towels were padded wet-on-dry with 2.0% citric acid without softener. All were dried for 15 minutes at 325° F. The respective three towels were washed and dried separately. The results are shown in Table V below.

TABLE V

| Color and treatment | % lint after 1 wash | % lint after 5 washes | % weight loss after 1 wash | % weight loss after 5 washes | pilling after 1 wash | pilling after 5 washes | tensile after 5 washes |
|---|---|---|---|---|---|---|---|
| Burgundy with citric acid (wet-on-dry) | n/a | n/a | n/a | n/a | n/a | n/a | Very Weak |
| Burgundy with citric acid + Springs Soft 3230 dry (wet-on-dry) | 0.2 | 0.5 | not determined | 1 | 5 | 5 | 29 |
| Navy with citric acid + Springs Soft 3230 wet-on-wet | 0.1 | 0.2 | 0.1 | 0.2 | 4 | 4 | 40 |

Note:
The pH's of the respective baths were 2.54, 2.40 and 2.34.

A similar moderating effect of Springs Soft 3020, a fatty amide/wax blend fabric softener, was found when used in conjunction with Catalyst 135B. A piece of a 100% cotton commercially available hunter green towel was padded wet-on-dry or wet-on-wet with 2% Catalyst 135B with or without 13.6% Springs Soft 3230, and was dried for 15 minutes at 325° F. before determining the filling tensile strength. The results are shown in Table VI below.

TABLE VI

| Catalyst 135B, % owb | 2 | 2 | 2 |
|---|---|---|---|
| Springs Soft 3230, % owb | 0 | 13.6 | 13.6 |
| Pad method | wet-on-dry | wet-on-dry | wet-on-wet |
| Filling Tensile, pounds | 20 | 33 | 30 |

EXAMPLE 6

The Yellowing Effect and Tensile Loss

To study the relative yellowing and tensile loss when using Catalyst 135B or citric acid, the following formulas were padded on bleached 100% cotton wash cloth fabric. In addition to the citric acid or Catalyst 135B, the pad bath contained Springs Soft 3230. The citric acid baths included 3.5 wt, % softener and the Catalyst 135B baths included 2.0 wt. % softener. The wet pick up was about 80%. The padded cloth was dried for 15 minutes at 325° F. Whiteness was determined using a Macbeth Color-Eye using the 7 (0–45) sensor with ultraviolet illumination included. Filling tensile was determined on the Scott tester and is the average of five or six individual breaks per sample. Light transmission results for the treatment baths were determined on a Spectronic 20 at 460 nanometers. The results of treatment with citric acid and Catalyst 135B are shown in Tables VII and VIII, respectively.

TABLE VII

| % Citric acid, owb | 0 | 0.1 | 0.2 | 0.4 | 0.6 | 0.8 | 1 | 1.2 | 1.4 | 1.6 | 1.8 | 2 |
|---|---|---|---|---|---|---|---|---|---|---|---|---|
| % Transmission | 100 | 54 | 53 | 53 | 54.5 | 52 | 54 | 56 | 55 | 57 | 55 | 56.3 |
| Whiteness | 64.88 | 58 | 63 | 61 | 58 | 52 | 44 | 45 | 42 | 38 | 35 | 37 |
| Tensile, lbs. | 55 | | | 49 | 47 | 48 | 45 | | | | | 42 |

TABLE VIII

| % 135B, owb | 0 | 0.5 | 1 | 1.5 | 2 | 2.5 | 3 | 3.5 | 4 | 4.5 | Original |
|---|---|---|---|---|---|---|---|---|---|---|---|
| % Transmission | 70 | 56 | 50 | 48 | 47 | 45 | 44 | 44 | 43 | 40 | |
| Whiteness | 59 | 61 | 64 | 65 | 61 | 56 | | | | 18 | |
| Filling Tensile | | 43 | 51 | 56 | 58 | 35 | | | | 22.5 | 65 |

NOTE: The above baths were prepared by diluting the Catalyst 135B in 80% of the total volume and then adding the Soft 3230. The mixes hazed immediately with the amount increasing somewhat with the concentration of softener. Even after standing overnight the mixes had not formed any precipitate.

The order of mixing the Catalyst 135B and softener was reversed and towels treated with this solution were also evaluated. In addition, the range of loss in tensile between 2.0 and 2.5% Catalyst 135B was examined in 0.1% increments. Results are shown in Table IX.

TABLE IX

| % 135B, owb | 2 | 2.1 | 2.2 | 2.3 | 2.4 | 2.5 |
|---|---|---|---|---|---|---|
| % Transmission | 60 | 61 | 60 | 60 | 60 | 60 |
| Whiteness | 59 | 56 | 51 | 52 | 46 | 41 |
| Fill Tensile | 53 | 49 | 52 | 47 | 46 | 46 |

Notes: Transmission values are improved with this order of mixing and there was no precipitous drop in tensile in this concentration range for Catalyst 135B.

While particular embodiments of the invention have been described, it will be understood, of course, the invention is not limited thereto since modifications may be made by those skilled in the art, particularly in light of the foregoing teachings. It is therefore contemplated by the appended claims to cover any such modifications that incorporate those features of these improvements in the true spirit and scope of the invention.

That which is claimed is:

1. A method for reducing pilling of a pillable, water absorbent cellulosic pile fabric, the method comprising:

applying a composition consisting essentially of 0.01 to 20% of an acidic agent based on the weight of the pile fabric and optionally a fabric softener to a cellulosic pile fabric; and heating the pile fabric for a time and under conditions sufficient to reduce pilling and to minimize decreases in the water absorbency thereof.

2. The method of claim 1, wherein the pile fabric comprises about 100% by weight cellulosic fibers.

3. The method of claim 1, wherein the acidic agent is selected from the group consisting of organic acids, mineral acids, acid-forming materials, and mixtures thereof.

4. The method of claim 3, wherein the organic acid comprises a compound selected from the group consisting of formic acid, citric acid, oxalic acid, malic acid, propionic acid, benzenesulfonic acid, toluenesulfonic acid, and mixtures thereof.

5. The method of claim 3, wherein the mineral acid comprises a compound selected from the group consisting of sulfuric acid, hydrochloric acid, phosphoric acid, nitric acid, and mixtures thereof.

6. The method of claim 3, wherein the acid-forming material comprises a compound selected from the group consisting of Lewis acids, acid forming salts and mixtures thereof.

7. The method of claim 6, wherein the acid forming material is selected from the group consisting magnesium chloride, magnesium bromide, magnesium sulfate, magnesium nitrate, zinc nitrate, ammonium nitrate, ammonium sulfate, ammonium chloride, zinc chloride, aluminum chloride, and mixtures thereof.

8. The method of claim 6, wherein said composition comprises an organic acid and an acid forming salt.

9. The method of claim 8, wherein said composition comprises malic acid and magnesium chloride.

10. The method of claim 1, wherein the composition comprises a fabric softener.

11. The method of claim 10, wherein the fabric softener is selected from the group consisting of cationic fabric softeners, non-ionic fabric softeners, anionic fabric softeners, and mixtures thereof.

12. The method of claim 1, wherein the pile fabric is heated at a temperature from about 200° F. to about 400° F. for about 3 to about 60 minutes.

13. The method of claim 1, wherein the pile fabric comprises at least about 80% by weight cellulosic fibers.

14. The method of claim 2, wherein the pile fabric is a 100% cotton towel.

15. The method of claim 14, wherein the towel is a pilled towel.

16. The method of claim 14, wherein the towel is substantially free of pills.

17. A method for reducing pilling of a pillable, water absorbent cellulosic towel, the method comprising:

applying a composition consisting essentially of about 0.01% to about 20% by weight of an acidic agent selected from the group consisting of organic acids, mineral acids, acid-forming materials and mixtures thereof a fabric softener to a 100% cotton towel; and heating the towel at a temperature ranging from about 285° F. to about 310° F. for about 3 to about 60 minutes.

* * * * *

UNITED STATES PATENT AND TRADEMARK OFFICE

CERTIFICATE OF CORRECTION

PATENT NO. : 6,051,034
DATED : April 18, 2000
INVENTOR(S) : Caldwell

It is certified that error appears in the above-identified patent and that said Letters Patent is hereby corrected as shown below:

Column 12,
Line 26, after "of" insert --a fabric softener and--;
Line 30, cancel "a fabric softener".

Signed and Sealed this

Third Day of July, 2001

*Attest:*

Nicholas P. Godici

*Attesting Officer*

NICHOLAS P. GODICI
*Acting Director of the United States Patent and Trademark Office*